US009731164B1

(12) United States Patent
Tung

(10) Patent No.: US 9,731,164 B1
(45) Date of Patent: Aug. 15, 2017

(54) STATIONARY BIKE COMPRISING CYLINDRICAL ELASTIC FEET

(71) Applicant: SINGULARITY LTD., Belize (BZ)

(72) Inventor: Chia Lin Tung, Taichung (TW)

(73) Assignee: Singularity Ltd., Belize (BZ)

( * ) Notice: Subject to any disclaimer, the term of this patent is extended or adjusted under 35 U.S.C. 154(b) by 13 days.

(21) Appl. No.: 15/013,051

(22) Filed: Feb. 2, 2016

(51) Int. Cl.

| | |
|---|---|
| ***A63B 22/06*** | (2006.01) |
| ***A63B 69/16*** | (2006.01) |
| ***A63B 21/02*** | (2006.01) |
| ***A63B 21/04*** | (2006.01) |
| ***A63B 23/04*** | (2006.01) |
| ***A63B 22/18*** | (2006.01) |
| ***A63B 23/035*** | (2006.01) |

(52) U.S. Cl.
CPC ..... *A63B 23/0476* (2013.01); *A63B 22/0605* (2013.01); *A63B 22/18* (2013.01); *A63B 23/03516* (2013.01); *A63B 23/03525* (2013.01)

(58) Field of Classification Search
CPC ..... A63B 69/16; A63B 22/0207; A63B 22/02; A63B 22/04; A63B 22/0605; A63B 2071/0063; A63B 23/04; A63B 23/0476; A63B 23/0458; A63B 2069/161; A63B 2069/162; A63B 2069/163; A63B 2069/164; A63B 2069/165; A63B 2069/166; A63B 55/50; A63B 22/06; A63B 22/14; A63B 22/16; A63B 22/18; A63B 26/003; A63B 2022/0635; A63B 2022/0641
USPC ..... 248/346.03, 346.04
See application file for complete search history.

(56) References Cited

U.S. PATENT DOCUMENTS

| | | | | | |
|---|---|---|---|---|---|
| 3,352,426 | A * | 11/1967 | Carlson | A63B 69/16 | 211/22 |
| 4,629,181 | A * | 12/1986 | Krive | A63B 69/18 | 482/146 |
| 5,441,468 | A * | 8/1995 | Deckers | A63B 22/0214 | 198/841 |
| 5,658,226 | A * | 8/1997 | Mentz | A63B 69/0035 | 472/126 |
| 5,795,277 | A * | 8/1998 | Bruntmyer | A63B 21/0004 | 280/87.041 |
| 7,438,672 | B1 * | 10/2008 | Rylander | A63B 22/0605 | 446/396 |
| 7,833,144 | B1 * | 11/2010 | Como | A63B 23/0458 | 482/142 |
| 2002/0077221 | A1 * | 6/2002 | Dalebout | A63B 26/003 | 482/57 |
| 2004/0242378 | A1 * | 12/2004 | Pan | A63B 22/0207 | 482/54 |

(Continued)

*Primary Examiner* — Sundhara Ganesan
*Assistant Examiner* — Nyca T Nguyen
(74) *Attorney, Agent, or Firm* — Rosenberg, Klein & Lee

(57) ABSTRACT

A stationary bike has a main frame. The main frame has a base that is configured to be laid on the ground. The base has its end surface facing the ground provided with a plurality of elastic feet that are arranged symmetrically with intervals therebetween for pressing on the ground. The elastic foot is made of a soft, elastic material and contains therein an inner space defined by a circular wall. When the elastic foot receives an external force from the base, the circular wall of the elastic foot deform correspondingly, thereby allowing the main frame to jolt and simulate road-riding experience.

8 Claims, 15 Drawing Sheets

(56) References Cited

U.S. PATENT DOCUMENTS

| | | | | |
|---|---|---|---|---|
| 2005/0020408 | A1* | 1/2005 | Park | A63B 23/0458 482/27 |
| 2007/0010377 | A1* | 1/2007 | Wu | A63B 69/16 482/61 |
| 2010/0288901 | A1* | 11/2010 | Wallach | A63B 22/0076 248/346.03 |
| 2012/0264579 | A1* | 10/2012 | Klein | A63F 13/807 482/146 |
| 2012/0322621 | A1* | 12/2012 | Bingham, Jr. | A63B 69/16 482/8 |
| 2014/0021317 | A1* | 1/2014 | Wu | G02B 7/021 248/346.03 |
| 2015/0111704 | A1* | 4/2015 | Lin | A63B 22/0605 482/57 |
| 2015/0238808 | A1* | 8/2015 | Lin | A63B 22/0605 482/57 |

* cited by examiner

STATIONARY BIKE COMPRISING CYLINDRICAL ELASTIC FEET

BACKGROUND OF THE INVENTION

1. Technical Field

The present invention relates to stationary bikes for indoor exercise, and more particularly to a stationary bike that provides simulation of road-riding experience.

2. Description of Related Art

It is often that people living a modern life are not free to perform physical exercise outdoors due to tight schedules or weather conditions. This fact has brought about the prevalence of indoor fitness/exercise gear. A stationary bike is a fitness device that provides simulation of cycling exercise, and it uses a stationary transmission to train and enhance a user's muscles and cardio-respiratory capacity.

As shown in FIG. 15, a conventional stationary bike mainly has a frame 91 for a user to sit thereon and an H-shaped base 92 supporting the frame 91 from below. The base 92 has its four bottom corners each equipped with an anti-slip foot 93 that presses on the ground. The anti-slip foot 93 has an upright screw 931 for being screwed into a threaded socket 921 raised from the base 92. Thereby, when the stationary bike has its base 92 laid on the ground, the anti-slip feet 93 stand on the ground to prevent the stationary bike in use from slip with respect to the ground.

However, when a user exercises using the conventional stationary bike as described above, he/she performs repeated pedaling movements without getting any kind of feedback from the stationary bike. Particularly, this working-out pattern lacks for feedback in the form of transverse jolts as experienced by the user when he/she otherwise rides a real bicycle on the road. Therefore, the conventional stationary bikes are inferior in providing lifelike riding experience and thus less interesting as exercise equipment for people to use.

SUMMARY OF THE INVENTION

One objective of the present invention is to provide a stationary bike, which provides simulation of road-riding experience.

Another objective of the present invention is to provide a stationary bike, which is applicable to conventional stationary bikes and has the advantages about easy and quick assembling operation and saving additional conversion costs.

For achieving the foregoing objectives, the disclosed stationary bike includes a main frame, the main frame having a base for standing the main frame on the ground, the base having an end surface facing the ground, the end surface being equipped with a plurality of elastic feet that are spaced and arranged symmetrically for configured to press on the ground, each said elastic foot being made of a soft, elastic material and formed as a hollow member, and each said elastic foot containing therein an inner space defined by a circular wall circling therearound, wherein when each said elastic foot receives an external force from the base, the circular wall deforms correspondingly, thereby making the main frame jolts to provide simulation of road-riding experience.

Preferably, the base has protrusions extended downward and each positionally corresponding to one said elastic foot, and the elastic foot has a top end configured to connect the corresponding protrusion of the base and a bottom end configured to press on the ground.

Preferably, the base has positioning holes each positionally corresponding to one said elastic foot, and the elastic foot has a top end configured to connect the base and a bottom end configured to press on the ground, while a positioning member has one end thereof enters the assembling hole from below through the inner space of the elastic foot and is retained in the positioning hole.

Preferably, the elastic foot has a top end configured to connect the base and a bottom end configured to press on the ground, and at least one of the top end and the bottom end has an end surface thereof provided with a plurality of ribs arranged radially into a circle centering an axis of the elastic foot.

Furthermore, the elastic feet is made of rubber, casting polyurethanes, thermoplastic carbon fiber composite materials (TP), nitrile-butadiene rubber (NBR) or thermoplastic polyurethanes (TUP), and has a Shore hardness between A12 and A80.

DETAILED DESCRIPTION OF THE INVENTION

Figure 1:
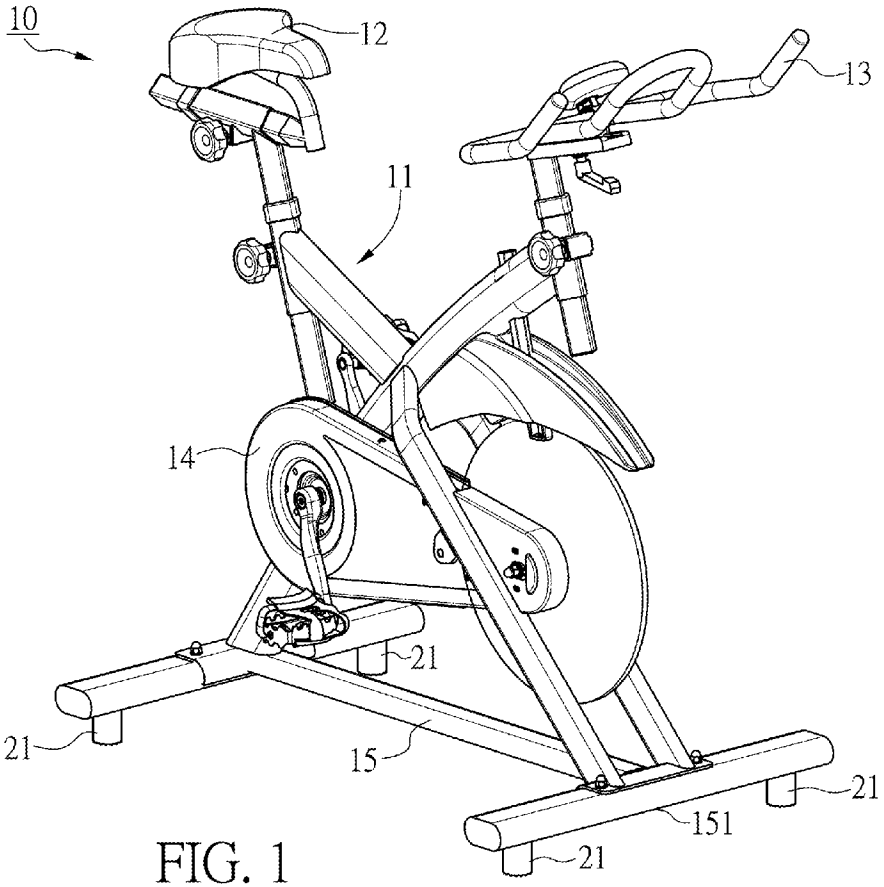
FIG. 1 is a perspective view of a first embodiment of the present invention.
Figure 2:
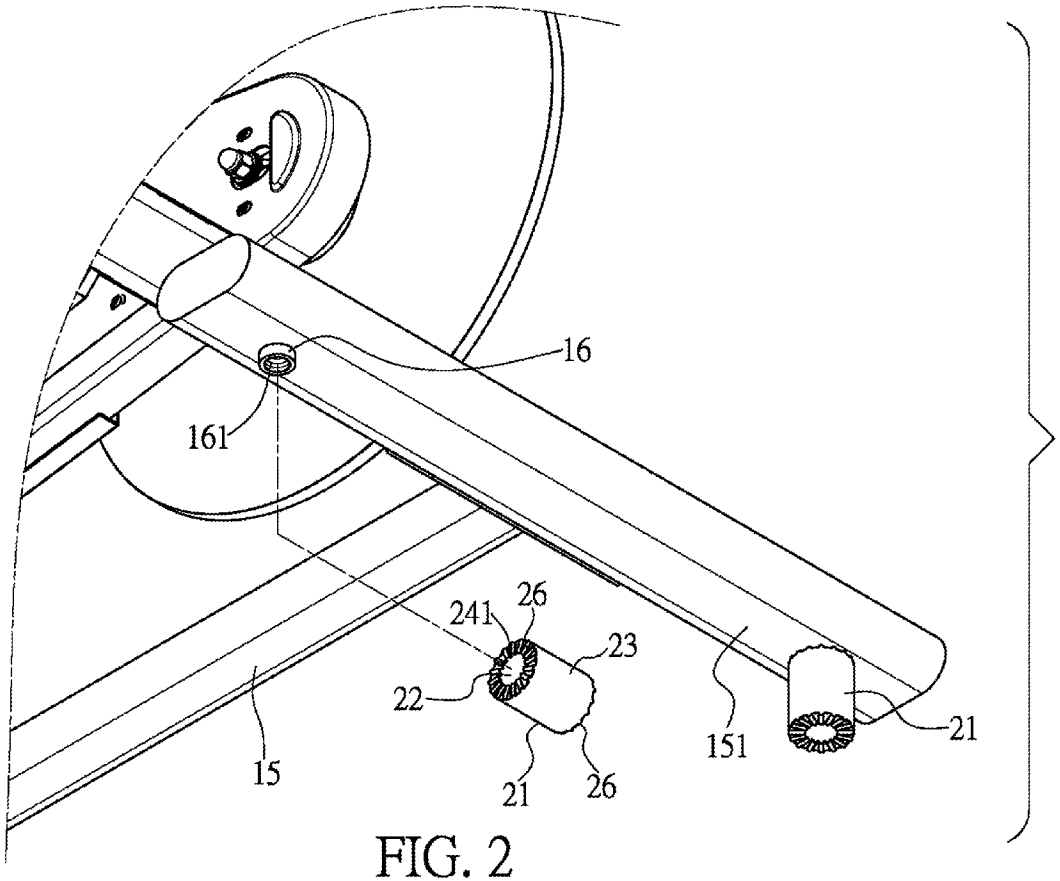
FIG. 2 is a partial, exploded view of the first embodiment of the present invention.
Figure 3:
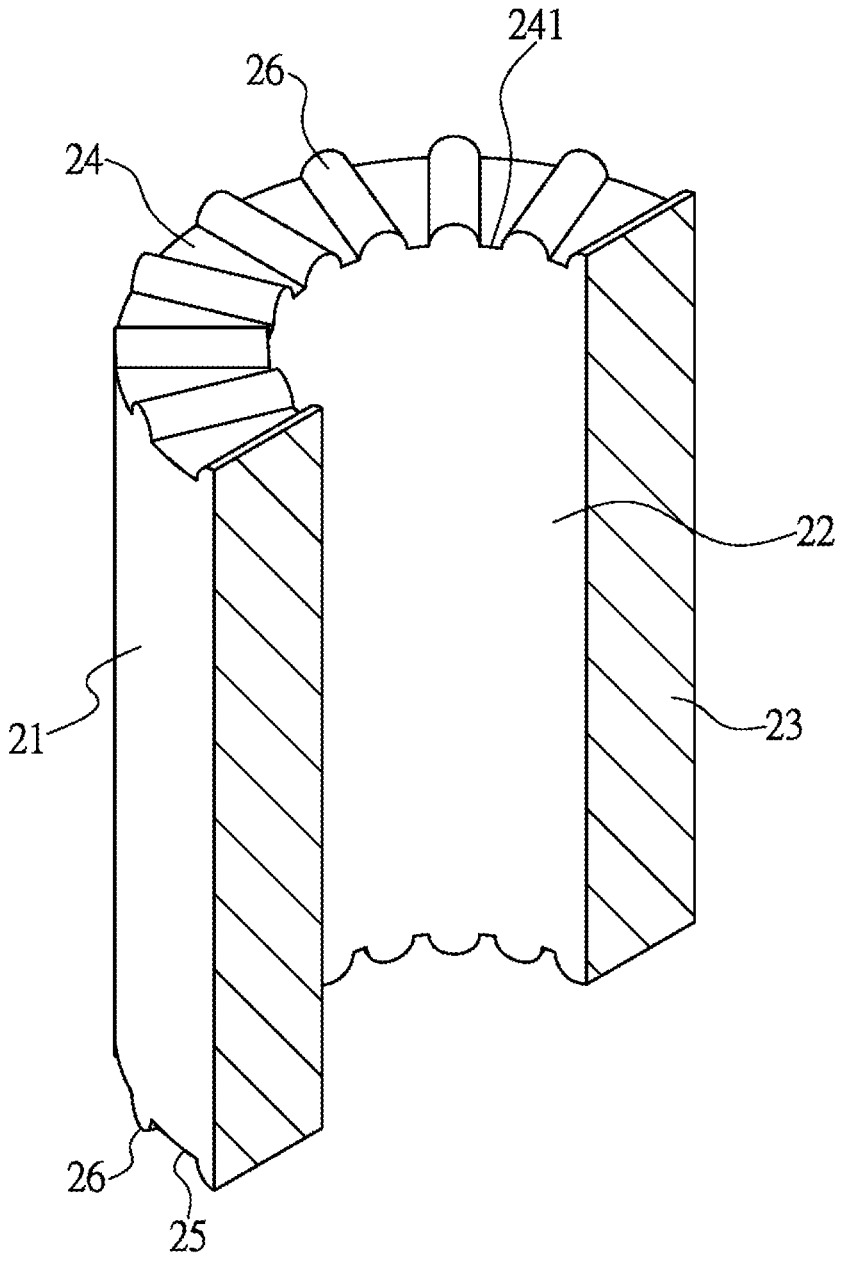
FIG. 3 is a cut-away view of an elastic foot as used in the first embodiment of the present invention.

Referring to FIGS. 1 through 4, in the first embodiment of the present invention, a stationary bike 10 comprises a main frame 11. The main frame 11 has a saddle 12 for a user to sit thereon, a handle 13 for the user to hole, and a crank mechanism 14 for the user to drive by pedaling. The main frame 11 stands on the ground 51 using a base 15 supporting it from below. The base 15 has an end surface 151 facing the ground 51 and a plurality of elastic feet 21 that are attached to the end surface 151 of the base 15 facing the ground 51 and arranged symmetrically with intervals therebetween. The elastic feet 21 are configured to press on the ground 51. In the present embodiment, the base 15 has an H-shaped body, and four elastic feet 21 are attached to four corners of the end surface 151 of the base 15, respectively. The elastic feet 21 may be made of a soft, elastic material, such as rubber, casting polyurethanes, thermoplastic carbon fiber composite materials (TP), nitrile-butadiene rubber (NBR) or thermoplastic polyurethanes (TUPs). The elastic feet 21 have a Shore hardness between A12 and A80, and preferably between A50 and A60. Most preferably, the elastic feet 21 has a Shore hardness of A60. Each of the elastic feet 21 is a hollow column containing therein an inner space 22. The inner space 22 is defined by a circular wall 23 circling therearound. Thus, when receiving a downward force from the base 15, the circular wall 23 of each of the elastic feet 21 elastically deforms.

In the present embodiment, the end surface 151 of the base 15 has protrusions 16 extended downward and each positionally corresponding to one said elastic foot 21. The elastic feet 21 has a top end 24 connecting the protrusion 16 of the base 15 and a bottom end 25 configured to press on the ground 51. The inner space 22 of the elastic feet 21 runs through the top end 24 and the bottom end 25, so that an assembling hole 241 is formed at the top end 24 of the elastic foot 21 for receiving the corresponding protrusion 16. Each of the elastic feet 21 uses the assembling hole 241 at its top end 24 to engage with the corresponding protrusion 16 on the base 15. Additionally, each of the elastic feet 21 has its end surfaces at the top and bottom ends 24, 25 each provided with a plurality of ribs 26 arranged radially into a circle centering an axis of the elastic foot 21, so as to increase frictional resistance between the elastic foot 21 and the base 15/the ground 51.

To apply the elastic feet 21 of the present invention to a conventional stationary bike that has its base provided with anti-slip feet facing the ground, a user can remove the anti-slip feet from the base, and assembles the elastic feet 21 with the base by engaging the assembling holes 241 with the threaded sockets raised from the base of the conventional stationary bike. With its inherent elasticity, the elastic foot 21 naturally has its assembling hole 241 fitting the periphery of the threaded socket, so that the elastic foot 21 is firmly attached to the end surface of the base facing the ground, thereby converting a conventional stationary bike into a stationary bike of the present invention.

Figure 4:
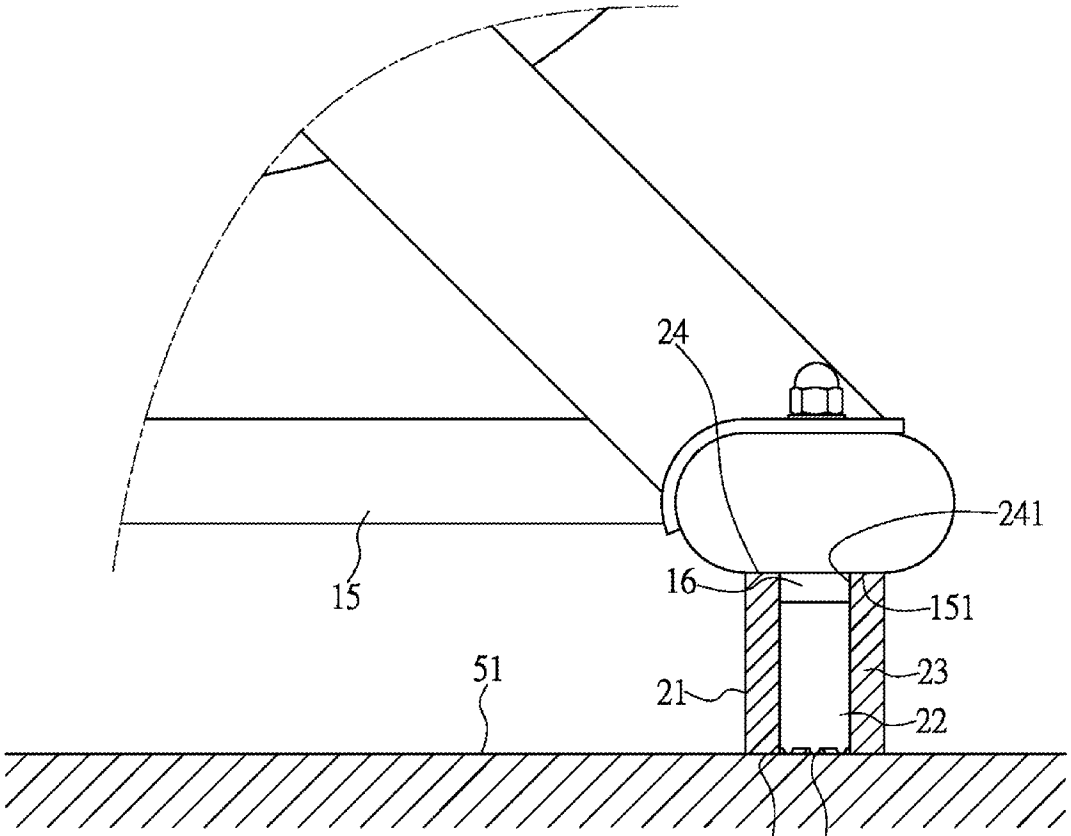
FIG. 4 schematically shows assembling details of the first embodiment of the present invention.
Figure 5:
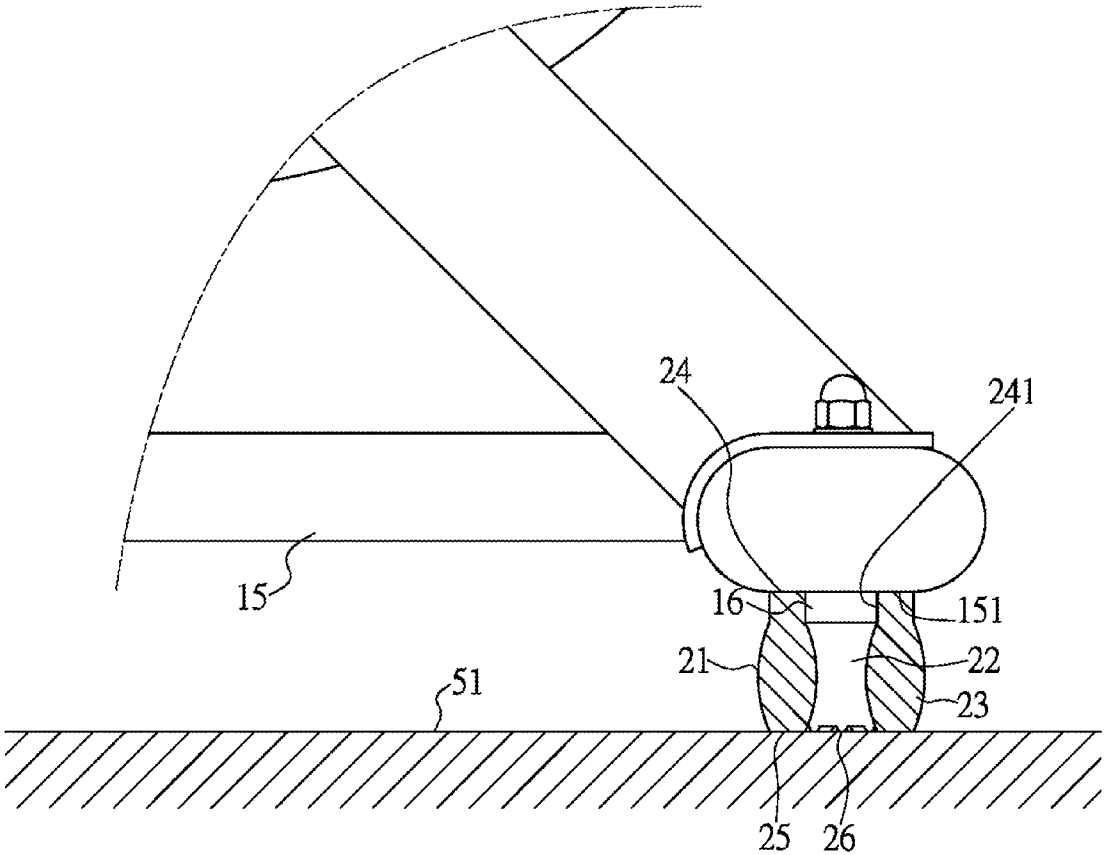
FIG. 5 schematically shows the first embodiment of the present invention in use.

Referring to FIGS. 4 and 5, in use of the present invention as configured above, since each of the elastic feet 21 presses on the ground 51 directly, the main frame 11 is supported over the ground 51 with springiness. When a user sits on the main frame 11 and performs pedaling exercise with his/her two feet, the force caused by the pedaling work is transmitted downward to the elastic feet 21 through the base 15, and each of the elastic feet 21, upon receipt of the pedaling force from the base 15, has its circular wall 23 elastically deform. Thereby, the main frame 11 is enabled to transversely jolt with the user's pedaling movements. The range of the transverse jolts of the main frame 11 is determined by the Shore hardness of the elastic feet 21 it uses. This allows the stationary bike to simulate road-riding experience, thereby significantly improving the joy and users' will about using the stationary bike. In addition, the disclosed stationary bike has the advantages of simple structure and low costs. In practical use, by simply replacing the anti-slip feet on a base of a conventional stationary bike with elastic feet 21 provided by the present invention, the conventional stationary bike is enabled to simulate road-riding experience. Hence, the present invention is extensively applicable to conventional stationary bikes, and provides the advantages about easy and quick assembling operation and saving additional conversion costs.

Figure 6:
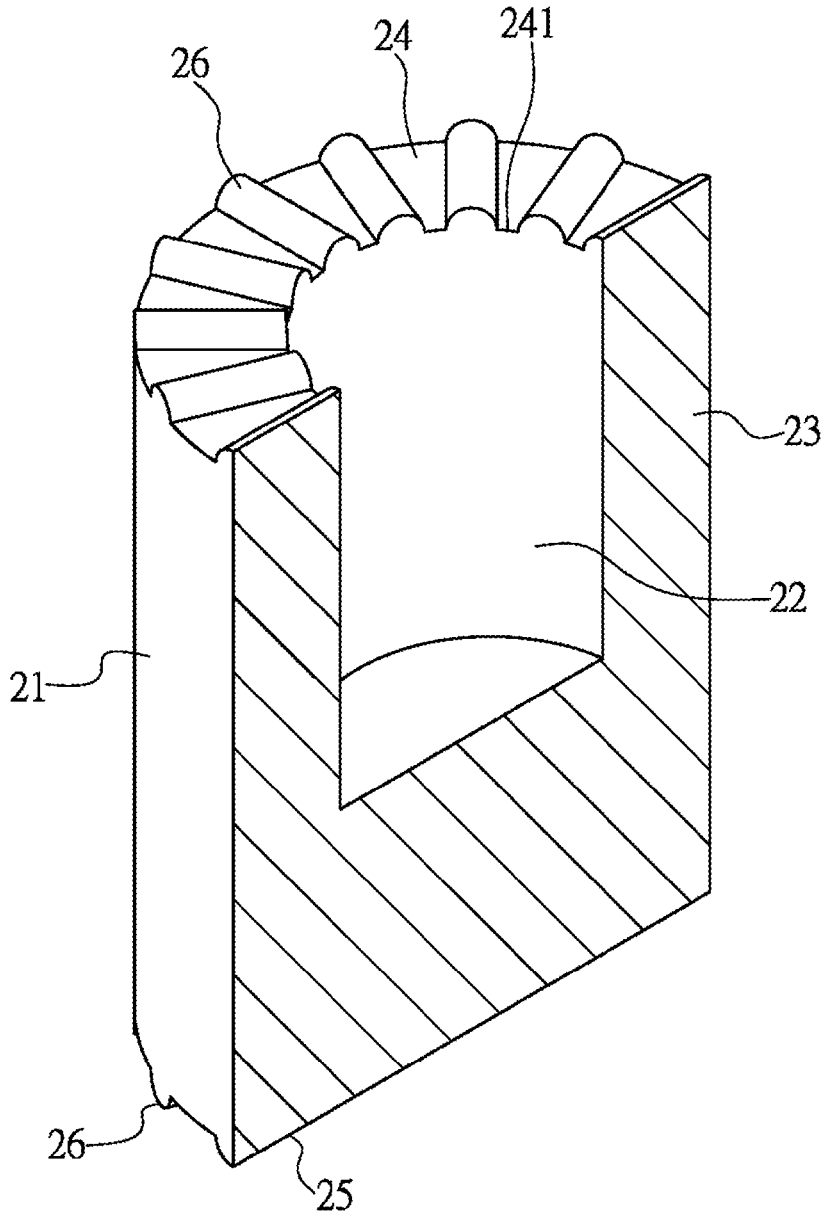
FIG. 6 schematically shows assembling details of a second embodiment of the present invention.
Figure 7:
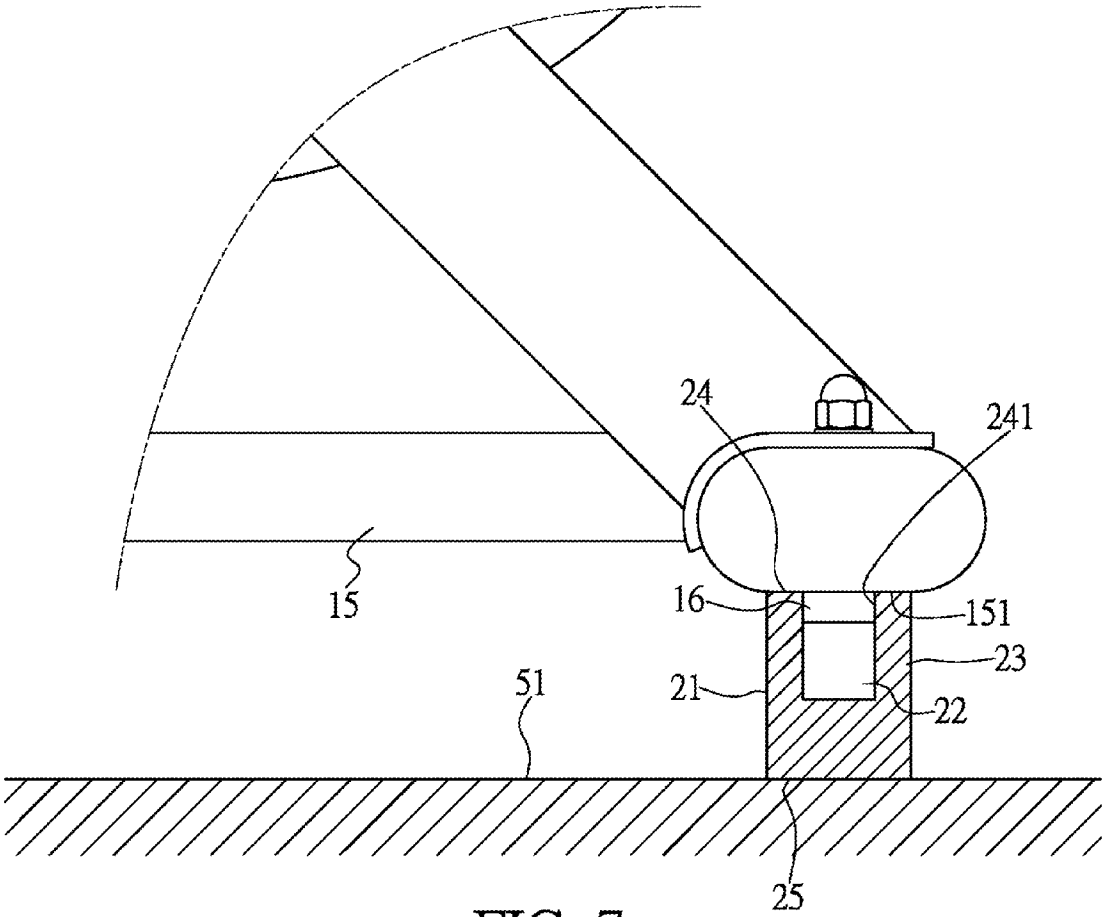
FIG. 7 is a cut-away view of an elastic foot as used in the second embodiment of the present invention.

Referring to FIGS. 6 and 7, the second embodiment of the present invention is different from the first embodiment for the facts described below. The elastic foot 21 has a top end 24 connecting the protrusion 16 of the base 15 and a bottom end 25 configured to press on the ground 51. The inner space 22 of the elastic foot 21 runs through the top end 24. The bottom end 25 of the elastic feet 21 is closed. At the top end 24 of the elastic foot 21, there is an assembling hole 241 depressed for receiving the protrusion 16. The elastic foot 21 has its assembling hole 241 engaged with the protrusion 16 of the base 15, so that the elastic feet 21 are attached to the end surface 151 of the base 15 that faces the ground 51. The elastic foot 21 also has the inner space 22 defined by a circular wall 23 circling therearound. Thus, when a user on the main frame 11 performs pedaling exercise with his/her two feet, the force caused by the pedaling work can also be transmitted to the elastic feet 21 through the base 15, thereby making the circular wall 23 of the elastic feet 21 elastically deform. As a result, the main frame 11 can also jolts transversely in response to the user's pedaling movements, so as to provide the effects and benefits related to simulated road-riding experience as provided by the first embodiment of the present invention.

Figure 8:
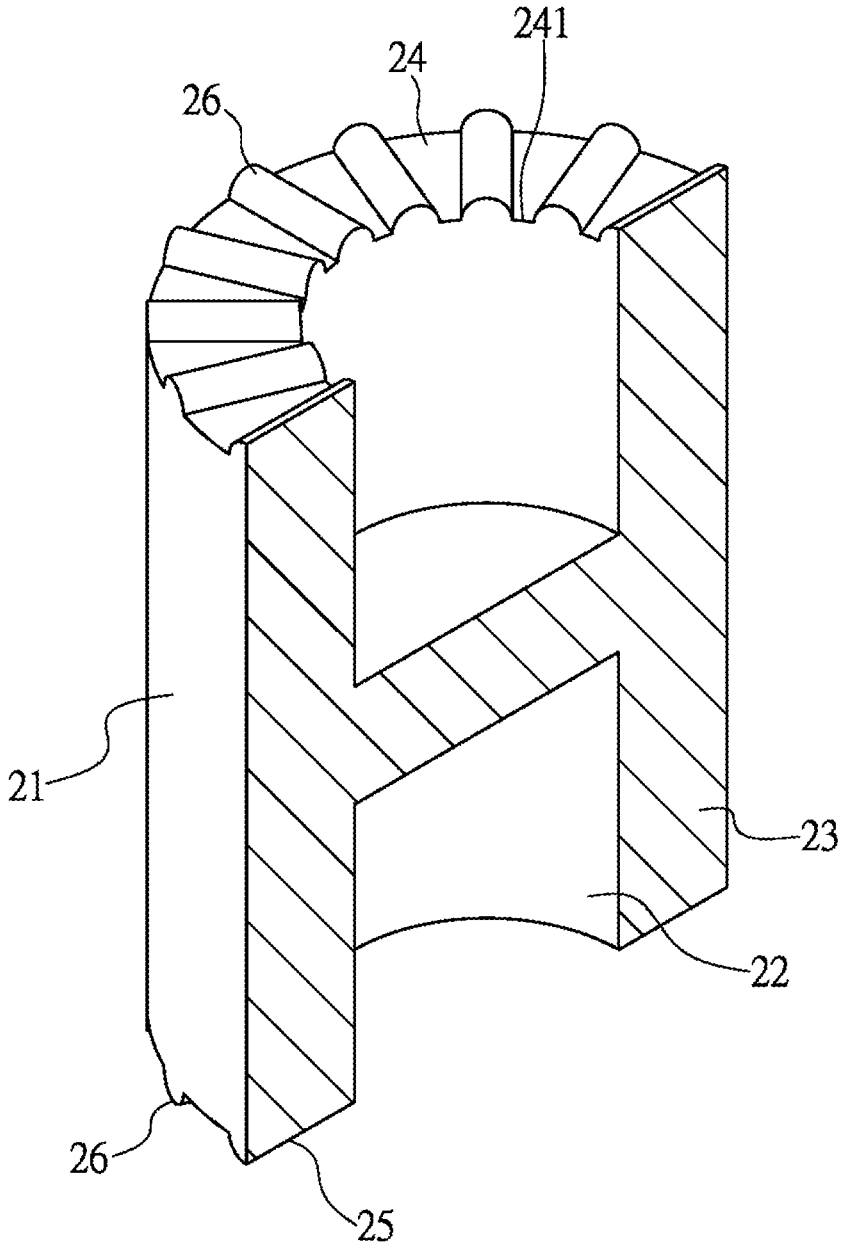
FIG. 8 schematically shows assembling details of a third embodiment of the present invention.
Figure 9:
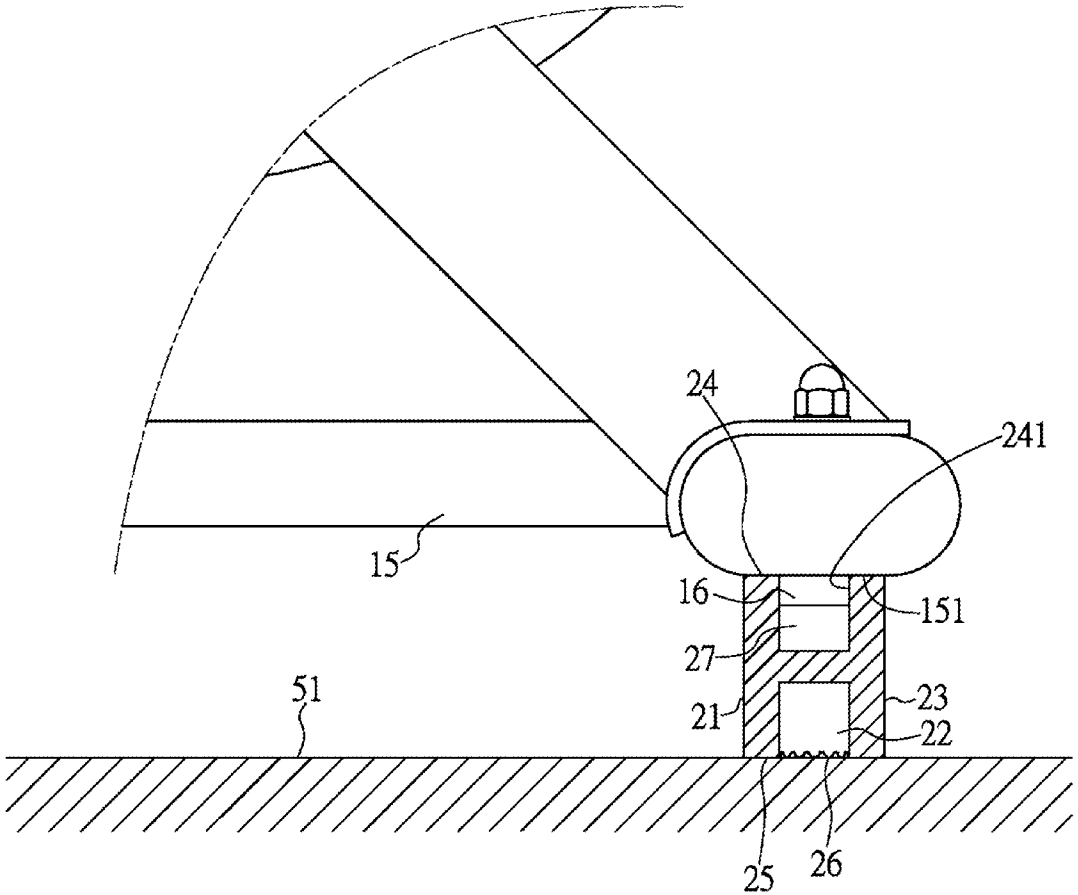
FIG. 9 is a cut-away view of an elastic foot as used in the third embodiment of the present invention.

Referring to FIGS. 8 and 9, the third embodiment of the present invention is different from the first embodiment for the facts described below. The elastic foot 21 has a top end 24 connecting the protrusion 16 of the base 15 and a bottom end 25 configured to press on the ground 51. The inner space 22 of the elastic foot 21 runs through the bottom end 25. At the top end 24 of the elastic foot 21, there is an assembling hole 241 depressed for receiving the protrusion 16. The assembling hole 241 is not communicated with the inner space 22. The elastic foot 21 has its assembling hole 241 engaged with the protrusion 16 of the base 15, so that the elastic feet 21 are attached to the end surface 151 of the base 15 that faces the ground 51. Therein, the assembling hole 241 has a depth greater than a height of the protrusion 16, so that another buffering space 27 is formed between the end of the protrusion 16 and the bottom of the assembling hole 241. The elastic foot 21 also has the inner space 22 defined by a circular wall 23 circling therearound. Thus, when a user on the main frame 11 performs pedaling exercise with his/her two feet, the force caused by the pedaling work can also be transmitted to the elastic feet 21 through the base 15, thereby making the circular wall 23 of the elastic feet 21 elastically deform. As a result, the main frame 11 can also jolts transversely in response to the user's pedaling movements, so as to provide the effects and benefits related to simulated road-riding experience as provided by the first embodiment of the present invention.

Figure 10:
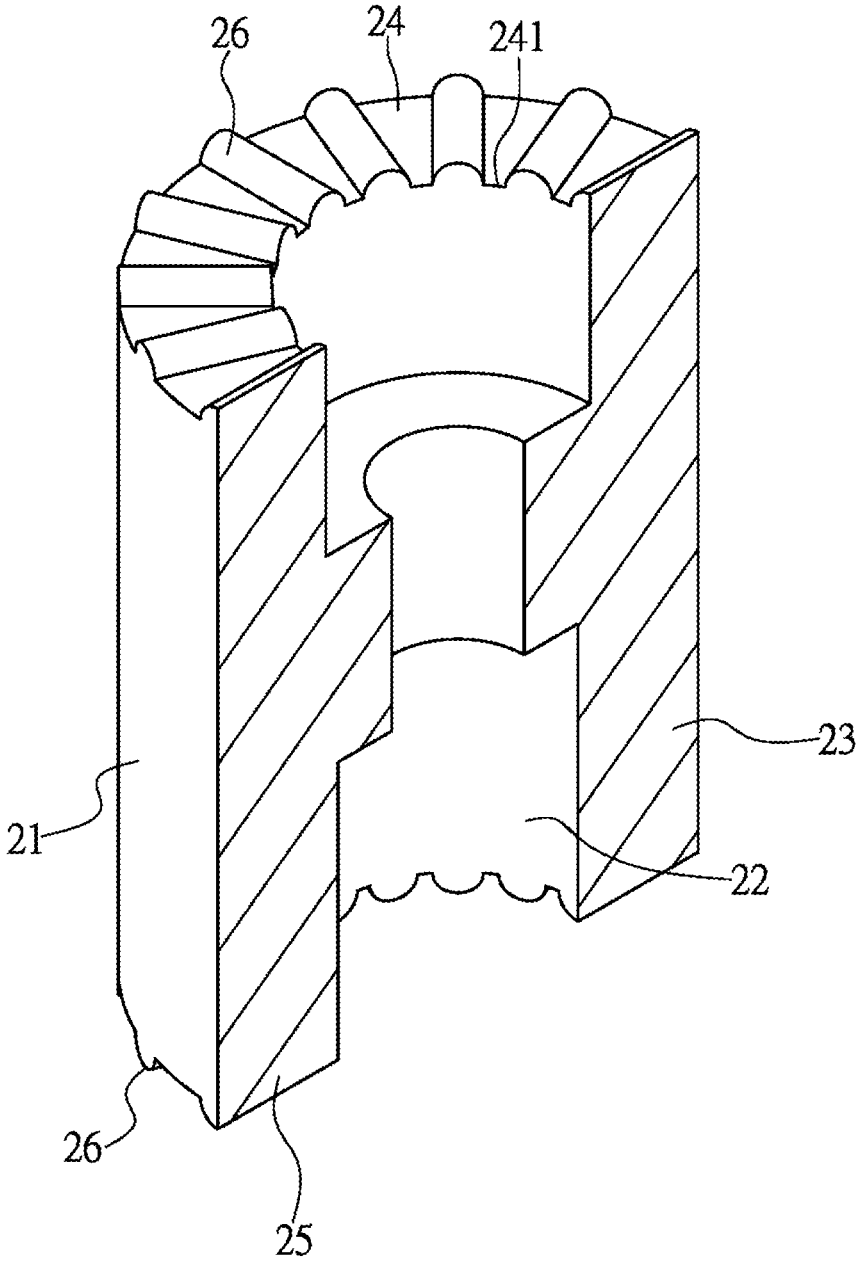
FIG. 10 schematically shows assembling details of a fourth embodiment of the present invention.
Figure 11:
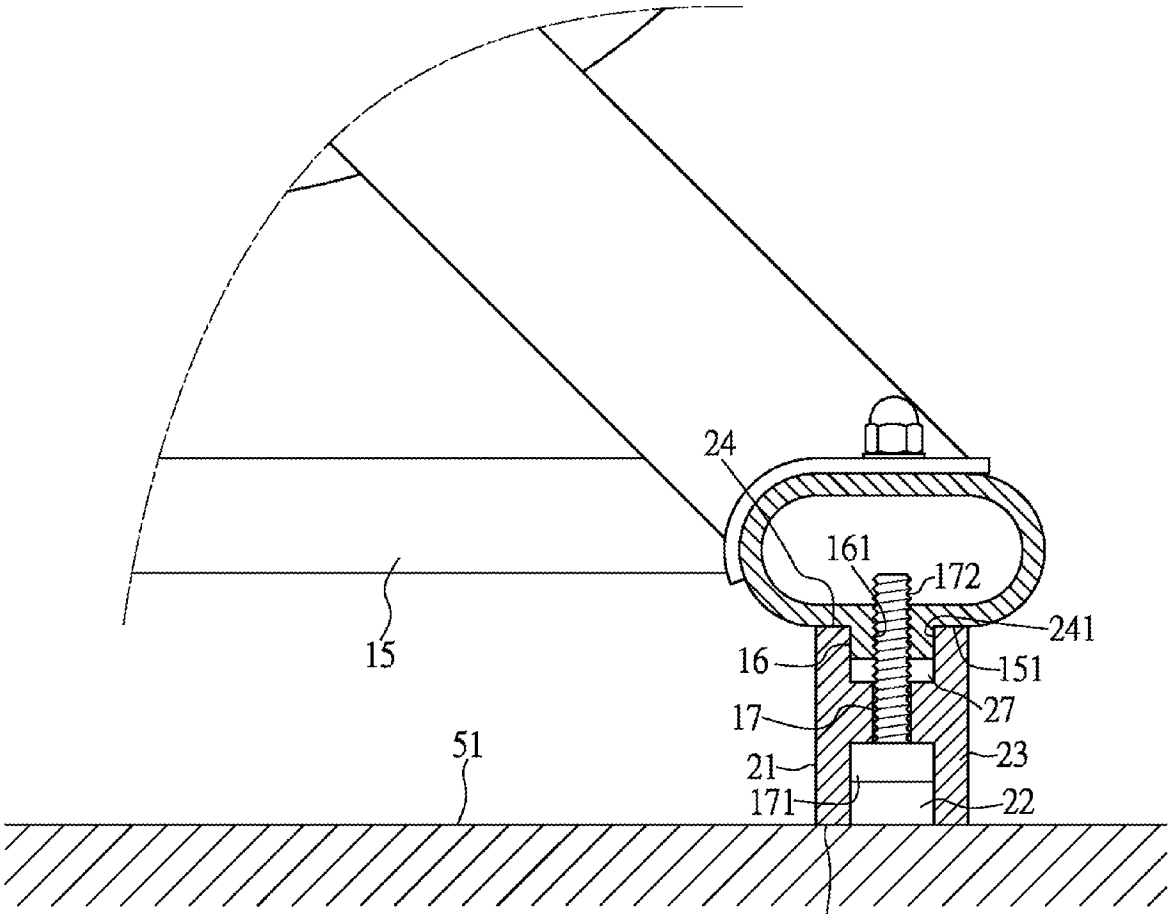
FIG. 11 is a cut-away view of an elastic foot as used in the fourth embodiment of the present invention.

Referring to FIGS. 10 and 11, the fourth embodiment of the present invention is different from the third embodiment for the facts described below. The elastic foot 21 has a top end 24 connecting the protrusion 16 of the base 15 and a bottom end 25 configured to press on the ground 51. The inner space 22 of the elastic foot 21 runs through the bottom end 25. At the top end 24 of the elastic foot 21, there is an assembling hole 241 depressed for receiving the protrusion 16. The protrusion 16 of the base 15 is provided with a positioning hole 161 that is a threaded hole. A positioning member 17 has a head 171 and a threaded segment 172. The head 171 of the positioning member 17 is received in the inner space 22, and the threaded segment 172 of the positioning member 17 goes upward to enter the assembling hole 241 through the inner space 22 of the elastic feet 21 before screwed into the positioning hole 161 of the protrusion 16. Thereby, the elastic feet 21 are screwed to the end surface 151 of the base 15 facing the ground 51. In addition, the threaded segment 172 of the positioning member 17 has an outer diameter smaller than the diameter of the assembling hole 241, so that another buffering space 27 is formed between the threaded segment 172 of the positioning member 17 and the assembling hole 241.

Figure 12:
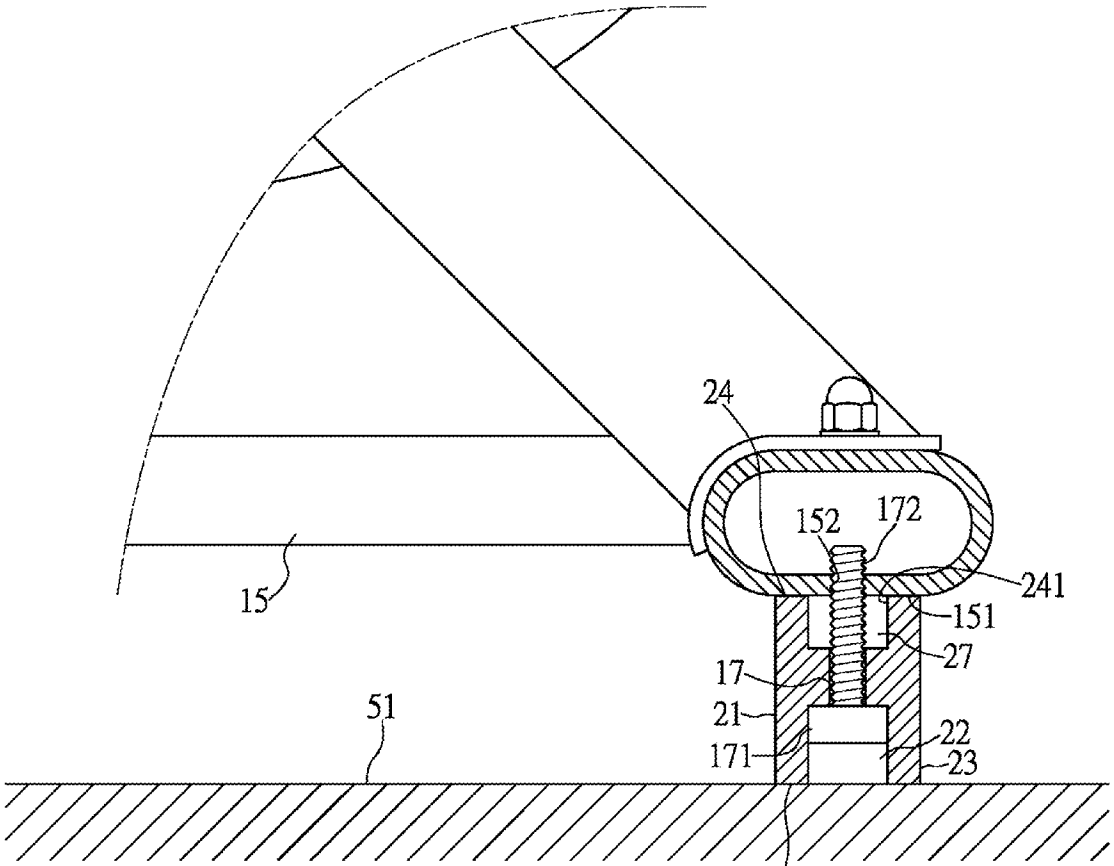
FIG. 12 schematically shows assembling details of a fifth embodiment of the present invention.

Referring to FIG. 12, the fifth embodiment of the present invention is different from the fourth embodiment for the facts described below. The base of the main frame is not equipped with raised, threaded socket. The base 15 of the main frame 11 has positioning holes 152 in the form of threaded holes each positionally corresponding to one of the elastic feet 21. The elastic foot 21 has a top end 24 connecting the protrusion 16 of the base 15 and a bottom end 25 configured to press on the ground 51. The inner space 22 of the elastic foot 21 runs through the bottom end 25. At the top end 24 of the elastic feet 21, there is an assembling hole 241 depressed. A positioning member 17 has a head 171 and a threaded segment 172. The head 171 of the positioning member 17 is received in the inner space 22, and the threaded segment 172 of the positioning member 17 goes upward to enter the assembling hole 241 through the inner space 22 of the elastic feet 21 before screwed into the positioning hole 152. Thereby, the elastic feet 21 are screwed to the end surface 151 of the base 15 facing the ground 51.

Figure 13:
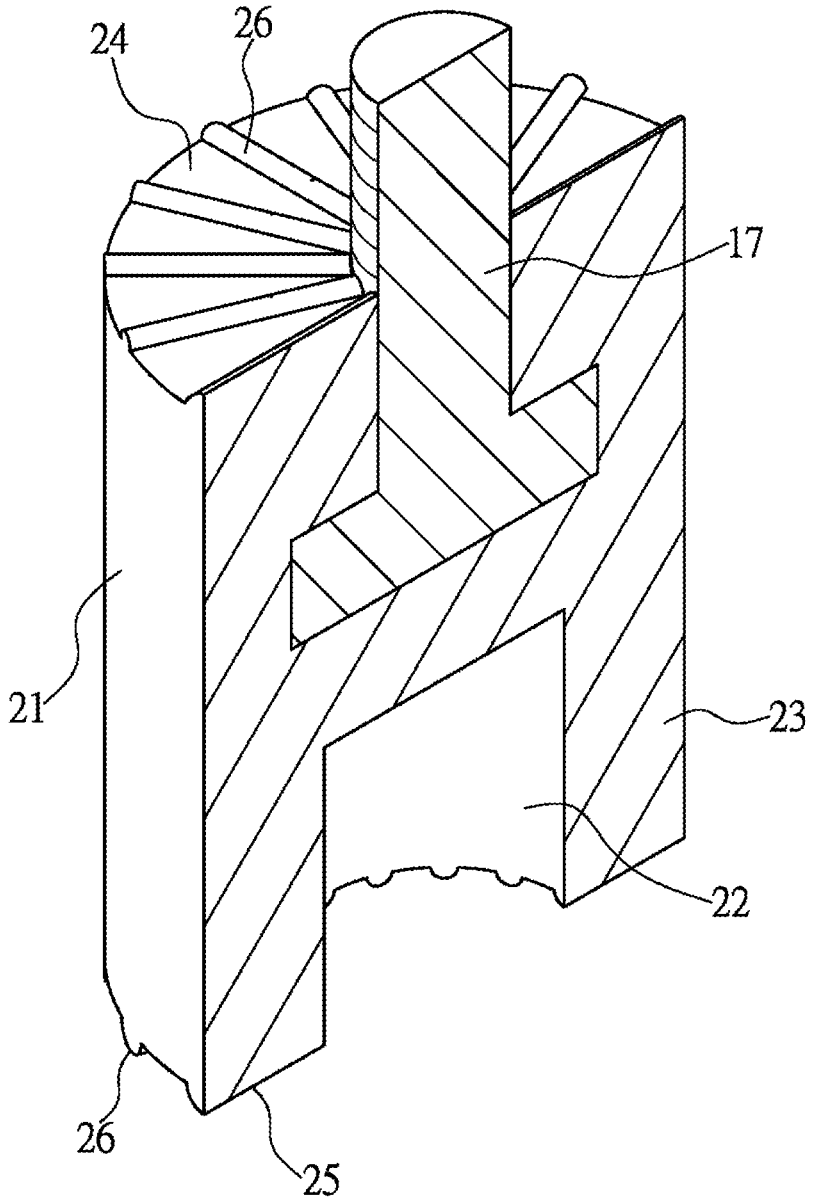
FIG. 13 schematically shows assembling details of a sixth embodiment of the present invention.
Figure 14:
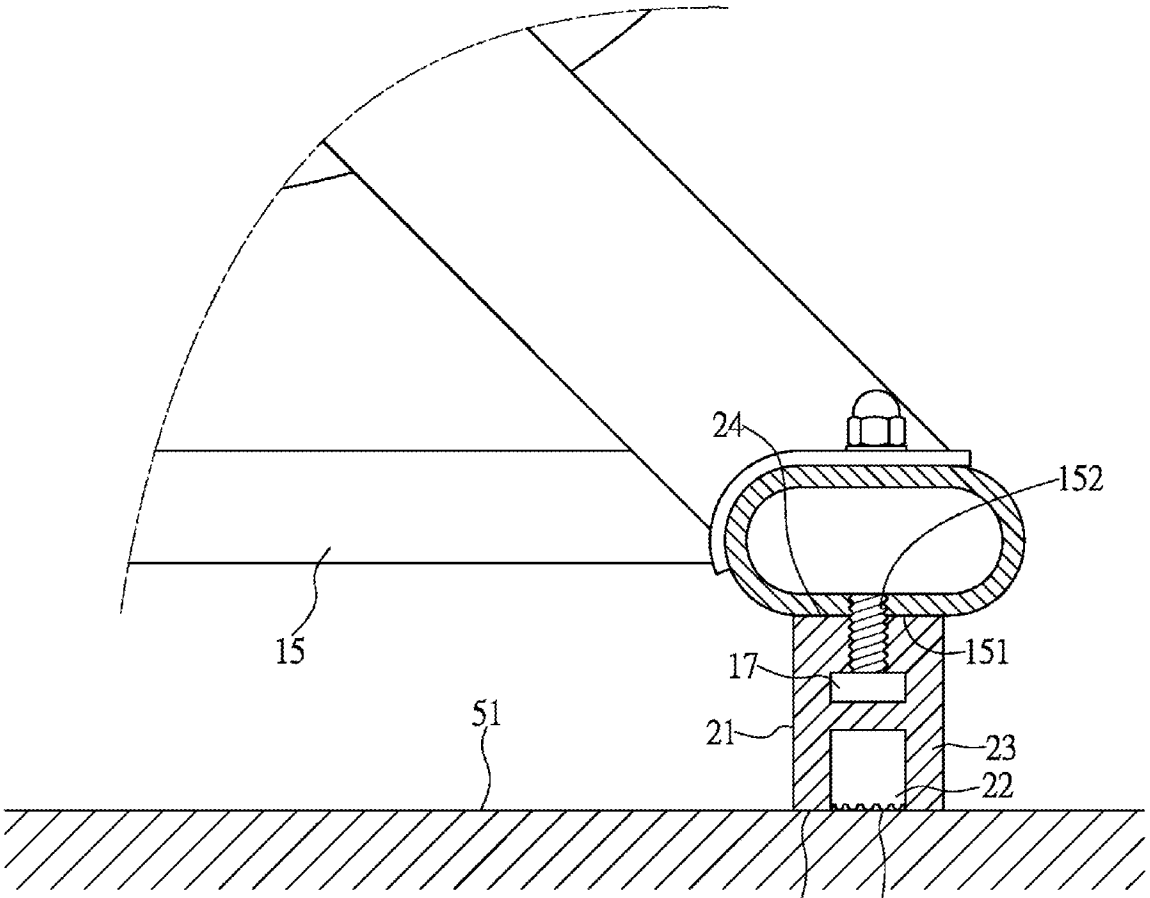
FIG. 14 is a cut-away view of an elastic foot as used in the sixth embodiment of the present invention.
Figure 15:
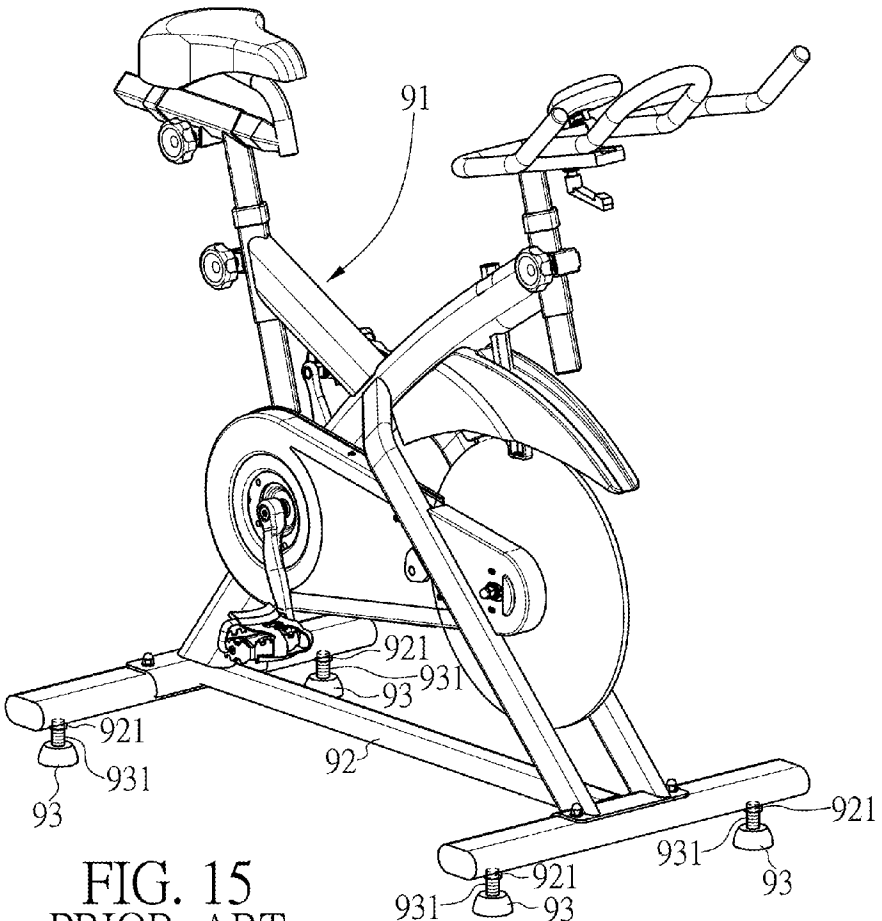
FIG. 15 PRIOR ART
FIG. 15 is a perspective view of a conventional stationary bike.

Referring to FIGS. 13 and 14, the sixth embodiment of the present invention is different from the fourth embodiment for the facts described below. The base 15 of the main frame 11 has positioning holes 152 each positionally corresponding to one of the elastic feet 21. The elastic foot 21 has a top end 24 connecting the protrusion 16 of the base 15 and a bottom end 25 configured to press on the ground 51. The inner space 22 of the elastic foot 21 runs through the bottom end 25. A positioning member 17 is inlaid in the top end 24 of the elastic foot 21. The positioning member 17 has one end jutting out of the top end 24 for being received in the positioning hole 152. In the sixth embodiment, the positioning hole 152 is a threaded hole and the positioning member 17 is a screw bolt. Thereby, when the positioning member 17 and the positioning hole 152 are screwed together and positioned mutually, the elastic foot 21 is attached to the end surface 151 of the base 15 facing the ground 51. This also applicable to the case where the base of the main frame is not equipped with raised, threaded sockets.

What is claimed is:

1. A stationary bike comprising a main frame, the main frame having a base for standing the main frame on the ground, the base having an end surface facing the ground, the end surface being equipped with a plurality of elastic feet that are spaced and arranged symmetrically, each elastic foot being made of a soft, elastic material and formed as a hollow member, each elastic foot containing therein an inner space defined by a circular wall circling therearound, the base having protrusions extending downward, each protrusion positionally corresponding to one of said plurality of elastic feet, each protrusion being provided with a positioning hole, each elastic foot having a top end configured to connect to the corresponding protrusion of the base and a bottom end configured to press on the ground, an assembling hole formed at the top end of each elastic foot for receiving the corresponding protrusion, one end of a positioning member entering the assembling hole of each elastic foot from below through the inner space of said elastic foot and being retained in the positioning hole of the corresponding protrusion, wherein the assembling hole of each elastic foot has a depth greater than a height of the corresponding protrusion, the protrusion and a bottom of the assembling hole thereby, forming a buffering space upon receipt of the protrusion, and wherein, when each elastic foot receives an external force from the base, the circular wall deforms correspondingly, thereby jolting the main frame to provide simulation of road-riding experience.

2. The stationary bike of claim 1, wherein each elastic foot is made of one of rubber, casting polyurethanes, thermoplastic carbon fiber composite materials, nitrile-butadiene rubber and thermoplastic polyurethanes.

3. The stationary bike of claim 2, wherein each elastic foot has a Shore hardness between A12 and A80.

4. The stationary bike of claim 1, wherein the inner space of each elastic foot runs through the top end and the bottom end.

5. The stationary bike of claim 1, wherein the inner space of each elastic foot runs through the top end.

6. The stationary bike of claim 1, wherein the inner space of each elastic foot runs through the bottom end, and the assembling hole of each elastic foot is depressed from the top end thereof.

7. The stationary bike of claim 1, wherein at least one of the top end and the bottom end of each elastic foot has an end surface thereof provided with a plurality of ribs arranged radially into a circle centering an axis of the elastic foot.

8. The stationary bike of claim 1, wherein each elastic foot is elastically and firmly fitted to a periphery of the corresponding protrusion.

* * * * *